US009161642B2

(12) United States Patent
Thompson et al.

(10) Patent No.: US 9,161,642 B2
(45) Date of Patent: Oct. 20, 2015

(54) UNIVERSAL POSITIONING ROLL

(71) Applicant: Latitude Innovations, Knoxville, TN (US)

(72) Inventors: Tracy Thompson, Knoxville, TN (US); Edward Mobley, Knoxville, TN (US); Eric Cox, Knoxville, TN (US)

(73) Assignee: Latitute Innovations, Knoxville, TN (US)

( * ) Notice: Subject to any disclaimer, the term of this patent is extended or adjusted under 35 U.S.C. 154(b) by 0 days.

(21) Appl. No.: 14/297,181

(22) Filed: Jun. 5, 2014

(65) Prior Publication Data

US 2014/0359944 A1 Dec. 11, 2014

Related U.S. Application Data

(60) Provisional application No. 61/831,350, filed on Jun. 5, 2013.

(51) Int. Cl.
*A47G 9/10* (2006.01)
*A61G 13/12* (2006.01)

(52) U.S. Cl.
CPC ..... *A47G 9/109* (2013.01); *A61G 13/122* (2013.01); *A61G 13/1285* (2013.01); *A47G 2009/1018* (2013.01)

(58) Field of Classification Search
CPC ..... A47G 9/109; A47G 2009/1018; A61G 13/122; A61G 13/1285
USPC ..... 5/639, 632, 640, 646, 648, 652, 655.9, 5/657; 128/845
See application file for complete search history.

(56) References Cited

U.S. PATENT DOCUMENTS

| | | | | |
|---|---|---|---|---|
| 5,544,377 | A * | 8/1996 | Gostine | 5/630 |
| D379,658 | S * | 6/1997 | Reynolds, III | D24/183 |
| 6,292,964 | B1 * | 9/2001 | Rose et al. | 5/630 |
| 6,345,401 | B1 * | 2/2002 | Frydman | 5/636 |
| 8,234,732 | B2 * | 8/2012 | Bacon | 5/636 |
| 8,516,639 | B2 * | 8/2013 | Mobley et al. | 5/640 |
| 2003/0033673 | A1 * | 2/2003 | Cuadra | 5/632 |
| 2005/0177944 | A1 * | 8/2005 | Kang et al. | 5/636 |
| 2010/0319707 | A1 * | 12/2010 | Cardin | 128/845 |

* cited by examiner

*Primary Examiner* — Michael Trettel
(74) *Attorney, Agent, or Firm* — Pitts & Lake, P.C.

(57) ABSTRACT

An adjustable positioning roll including a support portion having a support side and a substantially flat base surface, and one or more separately formed base portions, or elevating portions, configured to have a substantially same length and width as the flat base surface, the one or more base portions being detachably coupled to the flat base surface of the support portion.

4 Claims, 3 Drawing Sheets

UNIVERSAL POSITIONING ROLL

CROSS-REFERENCE TO RELATED APPLICATIONS

This application claims the benefit of U.S. Provisional Patent Application Ser. No. 61/831,350, filed on Jun. 5, 2013, the disclosure of which is incorporated herein in its entirety by reference.

FIELD OF INVENTION

The present general inventive concept relates generally to medical support devices, and, more particularly, to an adjustable positioning roll to support various parts of a patient's body.

BACKGROUND

The controlled positioning of patients is of significant importance in many surgical and convalescence procedures. Pillows or rolls contoured with special shapes have been developed to support a patient in one or more positions on an operating table during and/or after surgery.

In some examples in which a patient is maintained in an lateral or semi-lateral position during surgery, both of the patient's arms are extended at a 90 degree angle relative to the body, with one arm vertically positioned above the other arm, causing pinching of neurovascular components located in axilla which is at the juncture of the arm to the body. Prolonged compression can cause temporary or, in some cases, permanent damage to the nerve and vascular structures with the result being a loss of feeling, function or viability to the patient's arm.

Attempts have been made to reduce pressure of the components of the axilla with patient positioning on operating tables and beds including the use of pillows, towels, blankets, cushions, bolsters, or other devices to prop up the patient's chest, neck, feet, back, head, abdomen, or other anatomical regions. However, none of these devices have been entirely satisfactory, or even capable, of adequately supporting various anatomical regions of a patient's body to prevent pressure points and to provide stable, flexible, equal, and adjustable distribution of pressure points with a universal positioning device capable of multiple uses, and one which is cost-effective and disposable with each use to reduce possible patient cross-contamination.

Further problems with supporting devices made of gel or other materials are the inability to readily adjust the height to support various parts of a patient's body, to adequately relieve pressure points from the patient contact, to readily clean and maintain proper hygienic properties, to prevent slippage of the cushion, sliding of the patient, and so on.

BRIEF SUMMARY

The present general inventive concept provides an adjustable positioning roll including a supporting portion to accommodate multiple anatomical regions of a patient, and one or more detachable base portions, or elevating portions, which may be removed or attached to adjust the height and fit of the positioning roll, based on patient size and/or orientation.

Additional features of the present general inventive concept will be set forth in part in the description which follows, and, in part, will be obvious from the description, or may be learned by practice of the present general inventive concept.

Example embodiments of the present general inventive concept may be achieved by providing an adjustable positioning roll including a support portion having a support side and a substantially flat base surface, and one or more separately formed base portions, or elevating portions, configured to have a substantially same length and width as the flat side (base surface) of the upper portion to provide variable height and fit based on patient anatomy and/or orientation, the one or more base portions being detachably coupled to the flat side of the support portion with frictional contact to inhibit sliding and slippage of the pillow and/or patient.

The support side of the support portion may be configured to accommodate an anatomical region of a patient such that pressure from pressure points of the patient are evenly distributed over the support portion.

The support portion and/or base portions may be formed from a foam material having a coefficient of friction sufficiently high to inhibit slippage of the support portion relative to the base portion(s).

The one or more base portions may be a plurality of base portions coupled to the support portion in a stack such that a first base portion is coupled to the support portion, and any additional base portions are coupled to an adjacent base portion.

The base portions may be coupled to the support portion and/or one another by an adhesive compound.

The adhesive compound may be provided at a plurality of positions proximate corners of the elevating portions.

The adhesive compound may be configured in a circular shape on the elevating portions.

The base portions may be coupled to the support portion and/or one another by protruding and/or receiving portions provided to the support portion and base portions.

The support portion and/or elevating portions may be formed from a foam material that is compressible or elastomeric.

The support portion and/or elevating portions may be formed from a closed-cell foam material.

The support portion and/or elevating portions may be formed from a foam material fabricated from polyurethane foam, foam rubber, XPS foam, polystyrene, and/or phenolic material.

The support surface may be substantially arcuate.

The support surface may be configured to have one or more recessed portions to accommodate an anatomical region of a patient.

The support portion may be configured substantially as a semi-circle, wherein endpoints of the semi-circle define a width of the elevating portions.

The elevating portions may be formed from a foam material configured to be re-attachable to one another and/or the flat side of the support portion without use of an external attachment means.

Example embodiments of the present general inventive concept may also be achieved by providing an adjustable surgical positioning roll, including a support portion having a support surface having a cross section that is substantially semi-circular, a substantially flat base surface, and substantially flat ends, and one or more separately formed elevating portions configured to have a substantially rectangular shape having substantially the same length and width as the flat base surface, the one or more elevating portions being detachably coupled to the flat base surface of the support portion, wherein the elevating portions are configured to have a width that is substantially aligned with end points of the semi-circular support surface, and a length that is substantially aligned with the flat ends of the support portion.

The substantially flat base surface of the support portion may be configured to extend a predetermined distance from the end points of the semi-circular support surface and to have edges that are substantially aligned with the elevating portions.

Example embodiments of the present general inventive concept may also be achieved by providing an adjustable surgical positioning pillow including a pillow portion defining a semi-cylindrical shape and a substantially flat rectangular portion integrated with the semi-cylindrical shape, the substantially flat rectangular portion extending radially from the semi-cylindrical shape to define a first base surface of the pillow portion, a first elevating portion detachably formed with the first base surface and extending along a length and width dimension of said first base surface in overlying, parallel-planar relationship with said first base surface and terminating along a perimeter of said first base surface to define a second base surface extending a distance less than a radius of the semi-cylindrical shape from the first base surface, and a second elevating portion detachably formed with the second base surface and extending along a length and width dimension of said second base surface in overlying, parallel-planar relationship with said second base surface and terminating along a perimeter of said second base surface to define a third base surface extending a distance substantially equal to the distance that the second base surface extends from the first base surface.

Other features and aspects of the present general inventive concept will be apparent from the following detailed description, the drawings, and the appended claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 2:
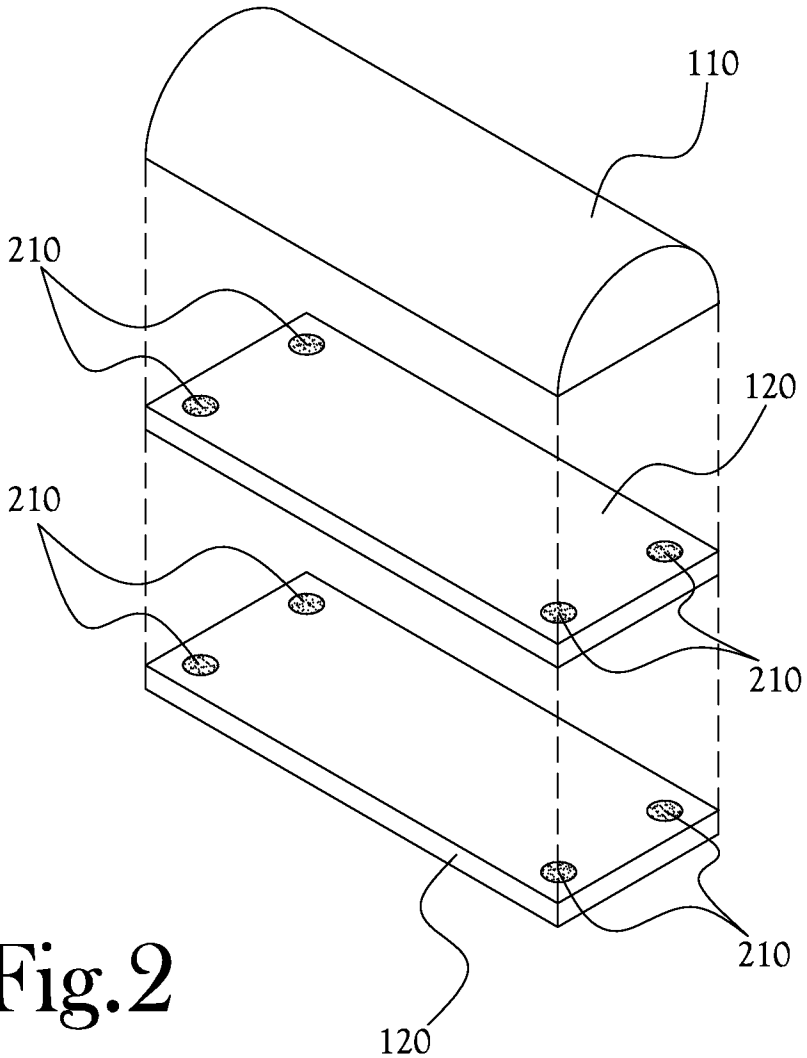
FIGS. 1-2 illustrate an adjustable positioning roll according to an example embodiment of the present general inventive concept.

Reference will now be made to various example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The described progression of processing operations described are merely examples, however, and the sequence of operations is not limited to that set forth herein and may be changed as is known in the art, with the exception of operations necessarily occurring in a certain order. Also, description of well-known functions and constructions may be omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Various example embodiments of the present general inventive concept, as described herein, provide an adjustable positioning roll with a height that can be adjusted by detaching or attaching portions of the positioning roll. In various example embodiments, the adjustable positioning roll includes a support portion having a support side and a substantially flat side, and one or more separately formed base portions configured to have a substantially same length and width as the flat side of the upper portion, the one or more base portions detachably coupled to the flat side of the support portion. Also, it is understood that the term "roll" is used in a general sense, and may be referred to as a pillow, cushion, etc.

In various example embodiments, the positioning roll may be fabricated from a foam material with a high static coefficient of friction. Generally, the foam material is compressible or elastomeric. In some example embodiments, a closed-cell foam may be used. Some example embodiments may include a foam fabricated from polyurethane foam, foam rubber, XPS foam, polystyrene, or phenolic material, but the present general inventive concept is not limited to any particular type of foam material. As will be described later, a foam material may lend various benefits, both economic and practical, over conventional positioning means, such as gel-based devices.

Figure 1:
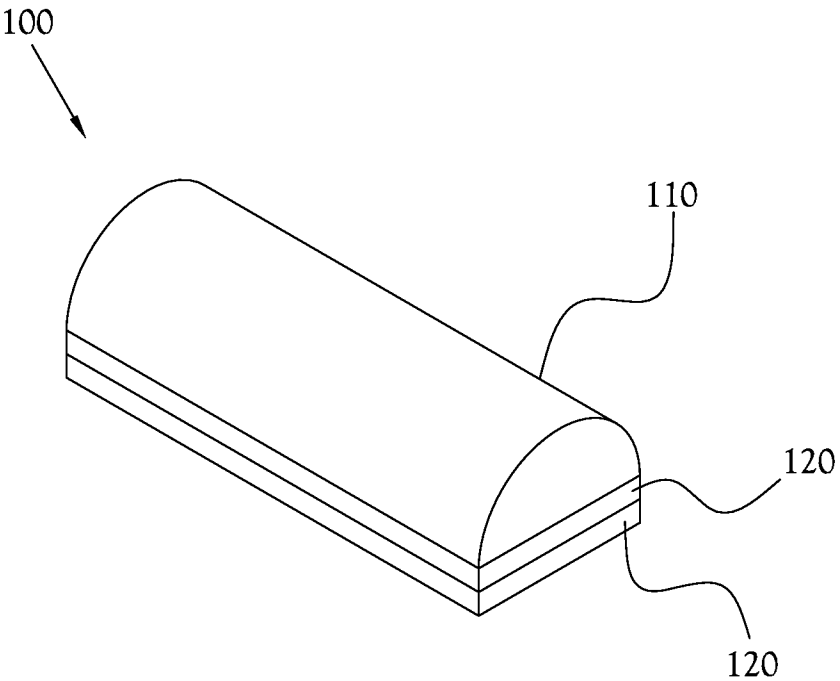

FIGS. 1-2 illustrate an adjustable positioning roll according to an example embodiment of the present general inventive concept. In this example embodiment, the adjustable positioning roll 100 includes a support portion 110 having a flat side and a curved support side to accommodate an anatomical region of a patient, and two separately formed base portions 120 configured to have substantially the same length and width as the flat side of the upper portion, the base portions 120 being attached to the flat side of the support portion 110 in a detachable manner. In more detail, as illustrated in FIG. 1, the base portions 120, which may or may not be formed of the same material as the support portion 110, according to various example embodiments, are separate bodies that are respectively attached to the support portion 110 or another base portion 120 so as to be stacked on top of one another. One or more of the base portions 120 may be removed, or then re-attached, to adjust the height of the positioning roll 100.

It is noted that while two base portions 120 are provided in the example embodiment illustrated in FIGS. 1-2, various other example embodiments may only include one base portion 120, or three or more base portions 120. In various example embodiments, one of the base portions 120 will be adhered to the flat side of the support portion 110, and any remaining base portions will be adhered to another of the base portions 120.

In the example embodiment illustrated in FIG. 2, the base portions 120 are adhered to the support portion 110 and/or each other by an adhesive compound 210 provided at various points on the base portions 120. The use of an adhesive compound 210 provides a good structural coupling so that the base portions do not easily come off of the rest of the assembly. However, even if one or more of these base portions are removed to lower the height of the positioning roll 100, the foam material used in some example embodiments lends to re-attachment of the previously detached base portion 120, due to the friction of the material preventing a sheering movement.

Other various example embodiments of the present general inventive concept may provide base portions 120 that are coupled to the support portion 110 and/or one another in different ways. For example, some example embodiments may provide protruding and/or receiving portions that are used to couple the bodies together. In more detail, one side of the base portions 120 may be provided with one or more protruding portions to be received in one or more corresponding receiving portions located on one side of another of the base portions 120. Such receiving portions may also be provided in the flat side of the support portion, and thus the interacting coupling action of all the protruding and receiving portions may allow a flat surface to be maintained on the flat side of the support portion 110 as well as one side each of the base portions 120, albeit flat sides with one or more receiving portions, so that the portion resting against a bed or other surface still has a substantially flat contact area.

According to various example embodiments of the present general inventive concept, the base portions 120 may be formed of the same material as the support portion 110, or may be formed of different materials. In some example embodiments, the base portions 120 themselves may be formed of different materials than one another. In some example embodiments, different ones of the base portions 120 may be provided in different colors to help a user easily distinguish the separation points between the various base portions 120.

Figure 3:
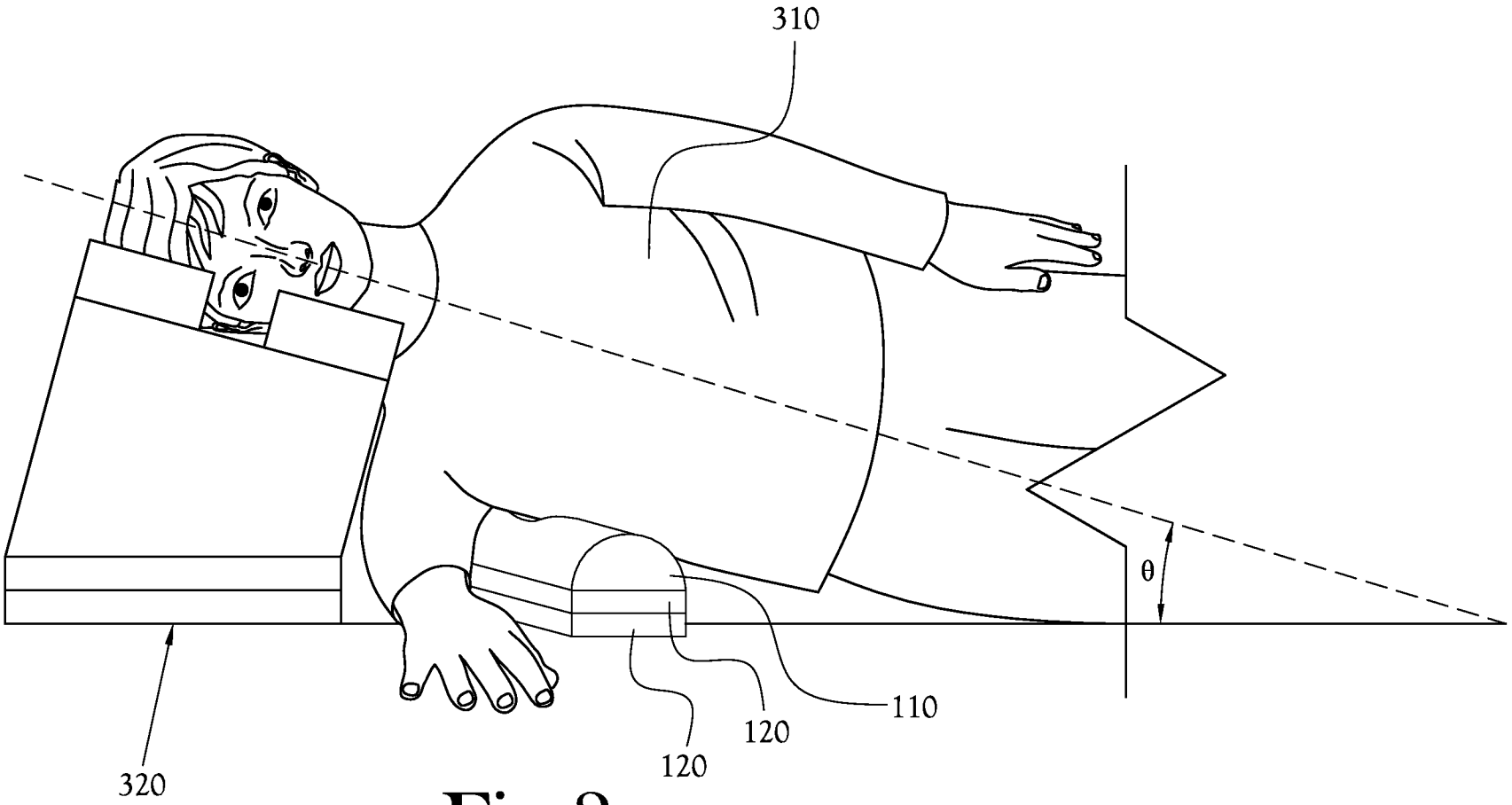
FIG. 3 illustrates an example use of the adjustable positioning roll of FIGS. 1-2, illustrating but one of the many multiple possible uses of the inventive positioning roll.

FIG. 3 illustrates an example use of the adjustable positioning roll of FIGS. 1-2. FIG. 3 illustrates a perspective view of a patient 310 lying on an operating table 320 in a lateral position with the head, shoulder, and arm of the patient accommodated and supported by a surgical positioning pillow under the head, and the adjustable positioning roll 100 used as an axillary roll that is configured in shape and size to be placed under the patient in the axillary region. The height of the surgical pillow under the head of the patient 310 causes an angle θ relative to the horizontal plane of the operating table 320, which leaves a gap between the patient 310 and the operating table 320 in the axillary region. When the patient 310 is positioned laterally with the arms extended out from the body, compression of the axilla can occur. The positioning roll 100, used in this embodiment as an axillary roll, is placed so there are 2-3 centimeters between the cephalad aspect of the roll and the axilla anterolaterally, and extending to the area beneath the scapula posterolaterally. This relieves the pressure from the neurovascular structures preventing brachial plexus nerve injury, to preserve blood flow to the dependent arm, and allows for better chest excursion. The adjustability allows the axillary to be used on patients of varying sizes. The flat bottom provides increased stability. The density of the foam reduces pressure related tissue injury. The increased coefficient of friction of the foam reduces slipping, thus provides a more stable platform. While the support portion 110 illustrated in FIGS. 1-3 has a support surface that is substantially arcuate, various example embodiments of the present general inventive concept may have a support surface that is contoured and/or provided with one or more recessed portions to accommodate an anatomical region of a patient.

While the example embodiment illustrated in FIG. 3 again shows the positioning roll 100 as having two base portions 120, it is understood that the height of the positioning roll 100 may be adjusted by removing one or more of the base portions 120 according to the patient's needs. The frictional nature of the foam material facilitates the ability to re-attach the base portions 120 as needed, enabling quick and easy height adjustment without slippage of the device or patient. For example, the base portions 120 may be formed from a foam material configured with a coefficient friction sufficiently high so as to be re-attachable to one another and/or the flat side of the positioning roll 100 without use of an external attachment means such as an adhesive.

It is understood that the example embodiment illustrated in FIG. 3 is merely one example of the configuration and use of the adjustable positioning roll of the present general inventive concept, and many other multiple possible uses of the positioning roll, at various other anatomical regions, may be provided, without departing from the broader scope and spirit of the present general inventive concept.

For example, according to various example embodiments, the adjustable positioning roll 100 may be configured and used as a chest roll. Patients positioned in a prone fashion have increased abdominal pressure, and decreased chest wall excursion. Increased abdominal pressure can compress the inferior vena cava, which decreases venous return to the heart. Decreased chest compliance results from direct pressure on the anterior chest wall from the weight of the body. This increases intrathoracic pressure which decreases venous return. The pressure on the chest also decreases chest wall compliance, thus making ventilation of the prone patient difficult. Patients may be positioned on chest rolls when in the prone position. The chest rolls may run from the periclavicular area to the iliac crests, and allow the chest wall to expand more freely, thus increasing compliance. Such use also allows the abdominal wall to expand, thus decreasing the intraabdominal pressure.

Figure 4B:
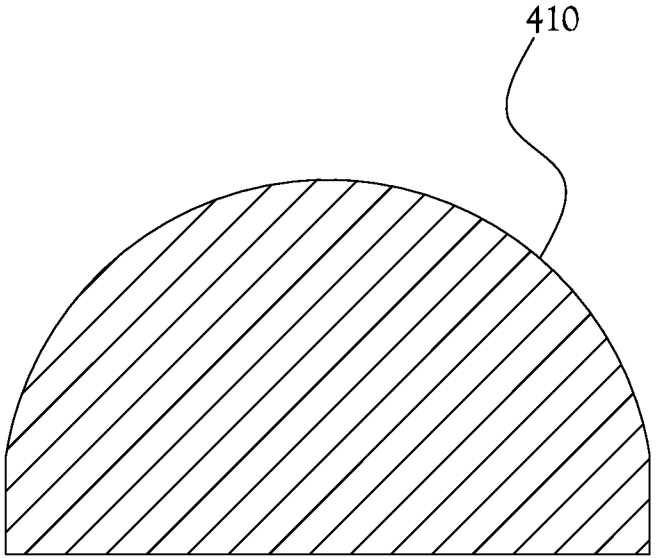
FIG. 4B illustrates an end view of a support portion according to another example embodiment of the present general inventive concept.
Figure 4A:
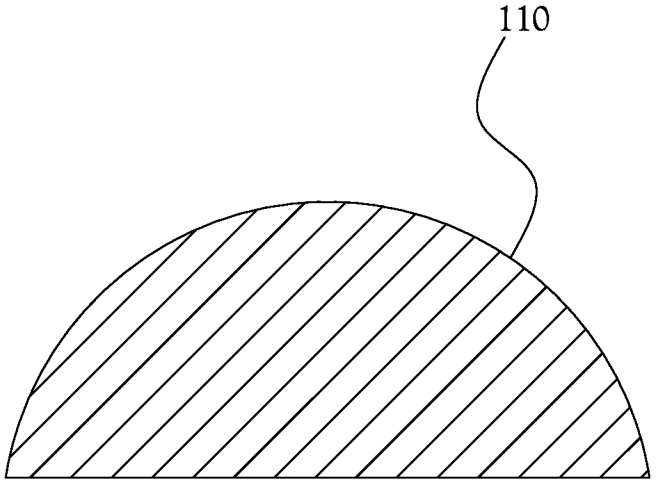
FIG. 4A illustrates an end view of the support portion of FIGS. 1-3.

According to various example embodiments, the adjustable positioning roll may include a support portion having a support surface having a cross section that is substantially semi-circular, a substantially flat base surface, and substantially flat ends, and one or more separately formed elevating portions configured to have a substantially rectangular shape having substantially the same length and width as the flat base surface, the one or more elevating portions being detachably coupled to the flat base surface of the support portion, wherein the elevating portions are configured to have a width that is substantially aligned with end points of the semi-circular support surface, and a length that is substantially aligned with the flat ends of the support portion. The substantially flat base surface of the support portion may be configured to extend a predetermined distance from the end points of the semi-circular support surface and to have edges that are substantially aligned with the elevating portions. For example, FIG. 4A illustrates an end view of the support portion 110 of FIGS. 1-3, and FIG. 4B illustrates an end view of a support portion 410 according to another example embodiment of the present general inventive concept in which the flat base surface extends from the endpoints of the arcuate surface of the support portion 410. It is understood that the term "semi-circular" as used herein can refer to a partial semi-circular or partial cylindrical configuration or a generally arcuate configuration, and not necessarily 180 degrees of arcuate surface. The extended flat base surface may have a similar thickness as the previously described elevating portions 120, but is not limited to such a configuration. Such a configuration, in which the support surface is effectively elevated above substantially straight edges that extend downwardly from the semi-circular support surface, may be particularly effective in supporting some portions of the body in which adjacent portions of the body may need to be closer to the positioning roll without being supported by the positioning roll, and/or to be abutted against the positioning roll. As described herein, the downwardly extending straight edges may be provided by the elevating portions and/or the extended flat base surface of the support portion.

According to other various example embodiments, the adjustable positioning roll 100 may be configured and used as a horizontal scapular roll. Positioning a patient for neck surgery typically involves extending the neck to allow for surgical exposure of the neck. Examples of this type of surgery include thyroidectomy, para thyroidectomy, and radical neck dissection. The same position is required to optimize exposure for internal jugular vein central line placement. The adjustable positioning roll 100 can be place horizontally along the superior aspect of the scapulas. This raises the superior aspect of the back relative to the occiput of the head and allows the head to fall back, thus improving surgical exposure. In other example embodiments, the positioning roll 100 can be configured and used as a vertical scapular roll. Positioning for median sternotomy and subclavian central line placement requires the shoulder to fall posteriorly to improve exposure. Placing the patient on the adjustable positioning roll such that the positioning roll 100 runs vertically along the spinous processes allows the shoulders to achieve this position.

According to other various example embodiments, the adjustable positioning roll 100 may be configured and used as a foot and ankle prop. The positioning roll 100 can be placed under the ankle to raise the foot off the plane of the surgical bed. This improves exposure of the foot for podiatric surgery.

According to other various example embodiments, the adjustable positioning roll 100 may be configured and used as a left lateral tilt. During a caesarean section the parturient must be placed in a left lateral tilt position to decrease the pressure the gravid uterus can place on the inferior vena cava and abdominal aorta. The positioning roll 100 can be placed under the right lateral aspect of the back to create this leftward tilt.

According to various embodiments of the present general inventive concept, an adjustable positioning roll having readily detachable and/or re-attachable base portions is provided. Different example embodiments of the present general inventive concept provide several benefits over the conventional approaches. For example, the relatively inexpensive construction and material used in the foam embodiment of the positioning roll affords single patient use of the roll, which decreases or eliminates cross-contamination and risk of patient dermatologic reaction to reusable positioner cleaning solution residue, which may be used on pillows formed of gel or other material, while reducing room turnover time. The typical current cleaning protocol for gel or other reusable positioners stipulates a specific drying time after the cleaning solution is applied, and a water rinse to then remove the cleaning solution residue prior to patient use. In cases in which such a protocol is not followed with those types of positioners, the risk of cross-contamination is highly increased. In cases in which the water rinse is not followed, then a dermatologic reaction to the cleaning solution residue can occur. Association of periOperative Registered Nurses (AORN) Standards and Practices dictate that rolled towels, blankets, sheets, or I.V. bags not be used for such purposes, as they are not considered to be positioning devices.

Further, due to the adjustable nature of the positioning roll according to various examples of the present general inventive concept, the positioning roll may be considered "universal" as it can be adjusted to fit various body types and/or situations. And when constructed of foam, as discussed in regard to various example embodiments in this description, the density of the foam allows for support without significant tissue pressure injury. The foam also has an increased coefficient of friction to decrease slipping of the positioning roll, and the stability may be further increased by having a flat "bottom". It is understood that the "bottom" simply refers to the surface of the positioning roll that is adjacent to a resting surface relative to the portion of a patient being supported by the positioning roll, such as an operating table, as the positioning roll has no required orientation facing up, down, or otherwise in the conventional sense.

It is noted that the simplified diagrams and drawings do not illustrate all the various connections and assemblies of the various components, however, those skilled in the art will understand how to implement such connections and assemblies, based on the illustrated components, figures, and descriptions provided herein, using sound engineering judgment.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

While the present general inventive concept has been illustrated by description of several example embodiments, it is not the intention of the applicant to restrict or in any way limit the scope of the inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings.

The invention claimed is:

1. An adjustable surgical positioning roll, comprising:

a support portion having a support surface having a cross section that is substantially semi-circular, a substantially flat base surface, and substantially flat ends; and one or more separately formed elevating portions configured to have a substantially rectangular shape having substantially the same length and width as the flat base surface, the one or more elevating portions being detachably coupled to the flat base surface of the support portion;

wherein the elevating portions are configured to have a width that is substantially aligned with end points of the semi-circular support surface, and a length that is substantially aligned with the flat ends of the support portion;

wherein the substantially flat base surface of the support portion is configured to extend a predetermined distance from the end points of the semi-circular support surface and to have edges that are substantially aligned with the elevating portions.

2. An adjustable surgical positioning pillow comprising:

a first base surface having a length and width dimension;

a top support portion having a semi-cylindrical shape and a substantially flat rectangular portion integrated with the semi-cylindrical shape, the substantially flat rectangular portion extending radially from the semi-cylindrical shape to define a pair of flat side surfaces extending from endpoints of the semi-cylindrical shape to the first base surface, the pair of flat side surfaces defining the width dimension of the first base surface; and a first elevating portion detachably formed with the first base surface and extending along the length and width dimension of the first base surface in overlying, parallel-planar relationship with the first base surface and terminating along a perimeter of the first base surface to define a second base surface extending a distance less than the radius of the semi-cylindrical shape from the first base surface.

3. The adjustable surgical positioning pillow of claim 2, further comprising:

a second elevating portion detachably formed with the second base surface and extending along a length and width dimension of said second base surface in overlying, parallel-planar relationship with said second base surface and terminating along a perimeter of said second base surface to define a third base surface extending a distance substantially equal to the distance that the second base surface extends from the first base surface.

4. The adjustable positioning roll of claim 3, wherein the top support portion is configured substantially as a semi-circle, wherein endpoints of the semi-circle define a width of the first and second elevating portions.

* * * * *